US012623314B2

(12) United States Patent
Hülsemann

(10) Patent No.: US 12,623,314 B2
(45) Date of Patent: May 12, 2026

(54) PRESSING ELEMENT FOR A GRINDING BELT, WITH COOLING

(71) Applicant: Hülsemann GmbH, Oberhausen (DE)

(72) Inventor: Thomas Hülsemann, Oberhausen (DE)

(73) Assignee: Hülsemann, Oberhausen (DE)

( * ) Notice: Subject to any disclaimer, the term of this patent is extended or adjusted under 35 U.S.C. 154(b) by 299 days.

(21) Appl. No.: 18/273,836

(22) PCT Filed: Jan. 17, 2022

(86) PCT No.: PCT/DE2022/200002
§ 371 (c)(1),
(2) Date: Jul. 24, 2023

(87) PCT Pub. No.: WO2022/156862
PCT Pub. Date: Jul. 28, 2022

(65) Prior Publication Data

US 2025/0001544 A1 Jan. 2, 2025

(30) Foreign Application Priority Data

Jan. 25, 2021 (DE) ..... 102021000350.0
Feb. 25, 2021 (DE) ..... 102021001016.7

(51) Int. Cl.
*B24B 21/10* (2006.01)
*B24B 21/08* (2006.01)
(Continued)

(52) U.S. Cl.
CPC ..... *B24B 21/10* (2013.01); *B24B 21/08* (2013.01); *B24B 21/18* (2013.01); *B24B 55/02* (2013.01)

(58) Field of Classification Search
CPC ..... B24B 21/10; B24B 21/18; B24B 21/08; B24B 21/00; B24B 21/008; B24B 21/04;
(Continued)

(56) References Cited

U.S. PATENT DOCUMENTS 4,628,640 A * 12/1986 Johannsen ..... B24B 21/14 451/303
5,295,329 A * 3/1994 Rothlisberger ..... B24B 21/10 451/303
(Continued)

FOREIGN PATENT DOCUMENTS

DE 1045634 B 12/1958
DE 2306660 A1 8/1974
(Continued)

*Primary Examiner* — Michael A Gump
(74) *Attorney, Agent, or Firm* — CAHN & SAMUELS, LLP

(57) ABSTRACT

The invention relates to a press-on element 1 for an abrasive belt 30, in particular for wide belt grinding machines, consisting at least of a backing material 10 with a padding 3 and a sliding layer 4. To clearly improve the grinding results, a method and a press-on element 1 based thereon are employed which permits an additional cooling of the padding 3 and thereby the abrasive belt 30. The press-on element 1 here substantially consists of a padding 3 consisting of a spacer fabric. The spacer fabric is manufactured from two loosely woven textile surfaces which are connected to each other by pile threads so that the cooling medium can flow through the padding 3.

15 Claims, 2 Drawing Sheets

(51) Int. Cl.
*B24B 21/18* (2006.01)
*B24B 55/02* (2006.01)

(58) Field of Classification Search
CPC ..... B24B 21/06; B24B 21/12; B24B 21/14; B24B 21/20; B24B 55/02; B24B 55/03
USPC ..... 451/56
See application file for complete search history.

(56) References Cited

U.S. PATENT DOCUMENTS

| | | | | |
|---|---|---|---|---|
| 5,613,901 | A * | 3/1997 | Weber | B24B 21/06 451/303 |
| 2010/0003900 | A1* | 1/2010 | Sakaguchi | B24B 21/06 451/539 |
| 2013/0059507 | A1* | 3/2013 | Breitenmoser | B24B 21/08 451/303 |

FOREIGN PATENT DOCUMENTS

| | | | | |
|---|---|---|---|---|
| DE | 3401462 | A1 | 8/1985 | |
| DE | 4114819 | C1 | 2/1992 | |
| DE | 19601379 | A1 | 3/1997 | |
| DE | 10343039 | A1 * | 4/2005 | B24B 21/10 |
| DE | 102010002539 | A1 | 9/2011 | |
| DE | 102010003616 | A1 | 10/2011 | |
| DE | 102017201970 | A1 | 8/2018 | |
| DE | 102017211192 | A1 | 1/2019 | |
| EP | 1716972 | B1 * | 8/2010 | B24B 21/08 |
| JP | 2003245852 | A | 9/2003 | |

* cited by examiner

PRESSING ELEMENT FOR A GRINDING BELT, WITH COOLING

CROSS REFERENCE TO RELATED APPLICATIONS

This application is the U.S. national stage of International Application No. PCT/DE2022/200002, filed on 2022 Jan. 17. The international application claims the priority of DE 102021000350.0 filed on 2021 Jan. 25 and the priority of DE 102021001016. 7 filed on 2021 Feb. 25.

BACKGROUND

The invention relates to a press-on element for an abrasive belt, in particular for wide belt grinding machines, consisting at least of a backing material with a padding and a sliding layer.

For calibration-grinding of large-surface workpieces, belt grinding machines, in particular wide belt grinding machines, are used in industry. In these belt grinding machines, a wide abrasive belt is driven by at least two rollers, the abrasive belt running along between the rollers on a grinding table. For pressing the abrasive belt flatly onto the workpiece, a press-on element is typically used. The press-on element here consists of a sanding pad device which is part of the belt grinding machine, and a sanding pad. The sanding pad device consists of a sanding pad mounting which serves to receive the sanding pad which is typically designed to be insertable into the sanding pad device. To reduce the wear of the abrasive belt on its back side and the sliding resistance, in prior art, a slideway lining is applied onto the sanding pad which permits the abrasive belt to be pressed onto the workpiece with little sliding resistance by the sanding pad. To achieve a uniform pressure of the abrasive belt on the flat workpiece, the sanding pad is padded, the padding layer being disposed between the sanding pad and the slideway lining. By the padding layer, the grinding pressure on slight elevations of the workpiece is higher than in small indentations in the surface of the flat workpiece. Thereby, an additional levelling of the workpiece surface is achieved. Another reason for employing a padding layer is that the closure of the abrasive belt has a material structure different from that of the rest of the abrasive belt due to the bonding at the fastening seam. During the passage of the abrasive belt closure through the grinding zone, mechanical impacts can thus occur which can be later clearly seen in the surface structure of the workpiece. The quality of the padding layer is therefore of great importance in the manufacture of the sanding pad.

In prior art, for pressing the abrasive belt onto the workpiece, wide sanding pads are used onto which a padding layer is glued with the aid of an adhesive, on the surface of which in turn a fabric belt is applied which carries graphite parts on its surface. To prevent the slideway lining from being worn away from the sliding pad by shear forces exerted on the sanding pad device by the grinding operation, it is here necessary to fasten the slideway lining at the sides of the sanding pad.

In the application of grinding machines in surface treatment, the pressing of the abrasive belt onto the workpiece is caused by a more or less flexible contact roller or via flat, usually padded press-on elements. The difference here is the substantially longer contact time of the abrasive grain during the flat pressure which naturally results in a better grinding result. As the demands on surface quality are increasing, above all, the correct choice of the shape and padding of the press-on element is decisive for a good grinding result.

However, simultaneously, increased friction occurs due to the longer contact time, leading to an increase in temperature in the grinding zone which can even lead to a burning of the abrasive belt. This temperature rise leads to problems in the surface and can drastically reduce the running performance of the abrasive belt. Moreover, by the temperature differences, uncontrollable expansions in the metal parts of the machine important for pressing often occur, which additionally makes precise working more difficult.

In general, for these reasons, one tries to keep the temperature as low as possible or to withdraw temperature from the grinding process.

Press-on elements basically always consist of three components, i.e. the backing, the padding and the sliding layer, the padding being the decisive part having an influence on the grinding result.

1. The Backing:

As backing materials, materials are suited which can assume bearing functions due to their own strength. They support and position the usually glued-on or clamped padding coating.

For this, e.g. metals, wood materials, plastics, firm papers or the like are suited. When selecting the materials, apart from the price, other technical points of view are also important, such as e.g. load-bearing capacity, flexibility, processability, and disposal.

2. The Padding

The tasks of the padding layer are, on the one hand, to cushion impacts that are caused by the connection point in the continuous abrasive belt and are visible as so-called chatter marks in the workpiece surface, and on the other hand, to compensate irregularities in the workpiece surface due to their more or less elastic properties. Only by this, the abrasive belt can cover the whole surface of the workpieces to grind them completely.

The most common padding materials are felts of different strengths made of wool or synthetic fibers, foams and rubber or rubber sponge. Combinations of these materials are also common.

3. The Sliding Layer

As a sliding layer, a dry lubricant in the form of graphite granules on a cloth backing is usually employed. The latter is normally glued, in rare cases also clamped, onto the padding layer. The sliding properties of the graphite reduce friction, resulting in energy saving of the drive. Simultaneously, the temperature resulting from the frictional heat is also reduced to minimize the above mentioned effects, if possible.

Attempts have been made to reduce the temperatures in the machine, and here especially in the working zone of the abrasive belt, by a cooling being supplied to the machine-side mounting of the press-on element via air or water. However, an effective cooling of the grinding process could not be sufficiently achieved thereby because the related above-mentioned padding materials are very good insulators, and a passage of a cooling medium through these materials is not possible by nature. The attempt to directly press the abrasive belt against the workpiece with an air cushion also failed. The air cushion could not transmit the contact pressure in a sufficiently defined manner to achieve a satisfactory grinding result.

In DE 196 01 379 A1, a device for pressing a circulating abrasive belt against the surface of a workpiece is disclosed. The employed pressure shoe has a felt layer as a compensating material which is nearly air-tight.

In DE 41 14 819 A1, a pressure shoe for a flat belt grinding machine is disclosed. The pressure shoe consists of a combination of felt and a pneumatic air cushion, wherein stiffening lamina are disposed between the pneumatic air cushion and the felt. The complex arrangement of layers of pneumatic air cushion, stiffening rods and press-on felt is necessary for the pressure shoe not to be distorted or deformed under the load in use. Simultaneously, the pneumatic air cushion is required for controlling the contact pressure of the pressure shoe. A cooling of the padding is also possible in this design.

SUMMARY

The invention relates to a press-on element 1 for an abrasive belt 30, in particular for wide belt grinding machines, consisting at least of a backing material 10 with a padding 3 and a sliding layer 4. To clearly improve the grinding results, a method and a press-on element 1 based thereon are employed which permits an additional cooling of the padding 3 and thereby the abrasive belt 30. The press-on element 1 here substantially consists of a padding 3 consisting of a spacer fabric. The spacer fabric is manufactured from two loosely woven textile surfaces which are connected to each other by pile threads so that the cooling medium can flow through the padding 3.

DETAILED DESCRIPTION

The technical problem underlying the present invention is to provide a novel padding which permits an active cooling of the padding, and a method for cooling the padding.

According to the invention, the problem is solved by the padding at least partially consisting of a spacer fabric. Further advantageous developments of the invention result from the subclaims.

The advantage of the present invention is that the padding consists of a spacer fabric which permits, without any negative influence on the grinding operation, a cooling medium to flow into the padding. As a cooling medium, gas is preferably possible, wherein air or an air mixture can be used in the simplest case. In this manner, an active cooling of the press-on element to the workpiece as close as possible to the contact zone of the abrasive belt is possible.

In a development of the invention, the padding here consists completely of a spacer fabric, or as an alternative, the padding includes a spacer fabric in the longitudinal and/or transverse direction which is hemmed by edge strips of another padding material in the longitudinal and/or transverse direction.

In a preferred embodiment, the padding can completely consist of a spacer fabric. However, it is also possible that the spacer fabric is arranged only in the central region of the padding, and this spacer fabric is hemmed by edge strips of another padding material in the longitudinal and/or transverse direction. By this measure, the cooling medium only flows through the central region of the padding, and a lateral escape of the cooling medium is prevented both in the transverse and in the longitudinal direction. Thereby, the cooling medium can completely spread within the padding if the latter consists of a spacer fabric.

In a development of the invention, the spacer fabric consists of at least two loosely woven textile surfaces which are connected to each other by pile threads. In the invention, so-called spacer fabrics are employed as padding which, in their design, have the possibility of being penetrated by cooling media. These materials obtain their flexibility by two loosely woven textile surfaces which are connected to each other by threads arranged perpendicularly, the so-called pile threads.

Knitted fabrics or warp knitted fabrics are characterized in that a plurality of meshes are formed in one step in which a number of needles simultaneously grip the thread multiply and wrap them each in bows through the loops. Preferably, such a method is performed mechanically. The advantage of the knitted fabrics or warp knitted fabrics is a higher elasticity of the textile fabric. While this involves low dimensional stability and lower strength, the knitted fabrics are run-proof and have an essentially increased elasticity. By the use of elastic fibers in the knitted fabric, elasticity can be moreover influenced.

In a development of the invention, the spacer fabric further has a low thickness tolerance, the thickness tolerance preferably being +/−5 hundredth of a millimeter.

The thickness tolerances have a direct influence on the grinding process and the grinding result by the pressure within a thicker zone being higher, due to an increased compression of the material, than in a thinner zone in adjacent regions of the padding. While typical padding materials, such as cellular rubber, rubber, rubber sponge, foams or the like, can have thickness tolerances of +/−1-2 tens of a millimeter or more due to manufacturing in a partial region, the thickness tolerances are clearly higher in hydrophilic materials, such as e.g., wool felts, due water absorption/discharge.

By the spacer fabric consisting of two loosely woven textile surfaces and the pile threads, it can be ensured that a low thickness tolerance is given which is, for example, +/−5 hundredth of a millimeter. The pile threads here determine the distance of the spacer fabric, so that a direct influence on the height of the padding is possible.

In a further development of the invention, the spacer fabric consists of moisture-stable synthetic fibers. By the use of moisture-stable synthetic fibers, the spacer fabrics are insensitive with respect to fluctuations in humidity which often leads to problems during the grinding process with hydrophilic materials.

In a development of the invention, a compressive strength of the padding can moreover be determined by the number of pile threads, the structure, length and/or thickness. The number, structure, length and thickness of the pile threads are variable which advantageously permits very different flexibilities. These flexibilities permit a plurality of compressive strengths matched with the grinding process, thus leading to optimized grinding results.

In a particular development of the invention, the spacer fabric can furthermore be penetrated by a cooling medium. By the structure of the spacer fabric with two loosely woven textile surfaces which are connected to each other by the pile threads, a penetration with a cooling medium which is approached to the padding layer through an interrupted backing element from the bottom side is possible. The cooling medium, for example a gas, particularly preferred air, can be approached past the pile threads directly to the sliding layer so that the cooling medium reaches the sliding layer in the direct vicinity of the grinding zone for the cooling. In this manner, the cooling medium can directly act on the padding and the temperature arising during the grinding process both in the padding and partially also on the abrasive belt, and it can clearly reduce the temperature.

In a further development of the invention, the cooling medium penetrates the spacer fabric via a first chamber of the sanding pad mounting of the wide belt grinding machine through at least one first passage, and, after it has flown through the spacer fabric, at least one second passage and one further chamber of the sanding pad mounting. The passages in the sanding pad mounting are here arranged such that it is ensured that the cooling medium completely flows through the padding. To this end, the cooling medium can be supplied through the first chamber under pressure to increase the flow velocity. The chambers are here located in the sanding pad mounting which typically consists of an aluminum profile with a plurality of struts provided for reinforcement. The struts of the sanding pad mounting here form the chambers so that they can be optimally used for having the cooling medium flow in. Preferably, the cooling medium is supplied such that it flows through the spacer fabric in the longitudinal and transverse directions.

To achieve the object of the method, in the grinding of large-surface materials, in particular wood or wood substitute materials, using a press-on element for the abrasive belt, a cooling of the press-on element is effected during the grinding process by a cooling medium which flows through the padding of the press-on element and leads to a reduction of the arising friction heat.

The cooling of the press-on element here has priority and leads to clearly improved grinding results. Here, an active cooling of the padding is possible, wherein the cooling medium can nearly completely penetrate the padding because the padding consists of a spacer fabric with two loosely woven textile surfaces which are connected to each other by pile threads. By the use of a cooling medium which can be approached directly to the sliding layer, thus not only the cooling of the padding, but also the cooling of the sliding layer in the direct vicinity of the grinding zone is advantageously ensured.

To keep the efforts for transporting the cooling medium as low as possible, the cooling medium is preferably supplied and discharged via the sanding pad mounting. This is possible because the sanding pad mounting typically consists of an aluminum profile with individual chambers which are defined by internal struts. One of these chambers can be used for supplying the cooling medium, while a second chamber can be employed for discharging the cooling medium.

It is particularly advantageous for the cooling medium to be supplied and discharged under pressure, so that a controlled flow of the cooling medium is ensured and can be varied by increasing the pressure depending on the grinding process. Here, the circulation or flow of the cooling medium via the sanding pad mounting through the padding has priority.

The present invention is characterized in that press-on elements for abrasive belts known per se offer the possibility of cooling the padding during the grinding process by using a suited padding material. This is achieved in that two loosely woven textile surfaces are used which are connected to each other by means of pile threads. The padding is thus extremely permeable for a cooling medium and leads to a uniform flow of the cooling medium through the padding to in this manner take care of a sufficient cooling of the padding or the abrasive belt, respectively, over the whole length of the press-on element. The invention is thus characterized by an applied method for cooling the padding as it has not been known up to now.

The invention will be further illustrated more in detail with reference to the figures.

DETAILED DESCRIPTION OF THE PREFERRED EMBODIMENTS

Figure 1:
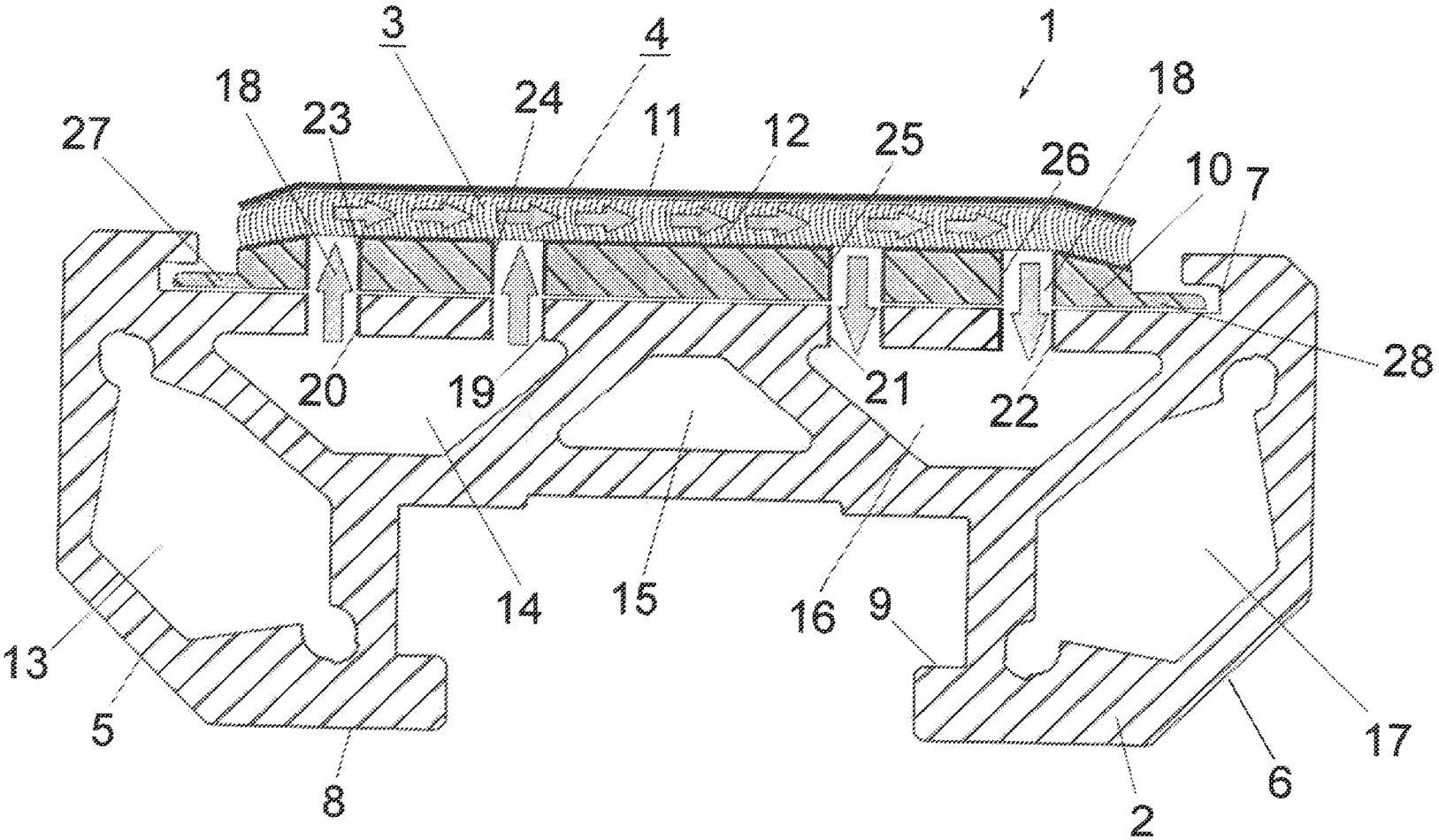
FIG. 1 shows a sectional representation of a press-on element.

FIG. 1 shows a press-on element 1 with a sanding pad mounting 2, a padding 3, and a sliding layer 4.

The sanding pad mounting 2 has a nearly rectangular cross-section with two chamfers 5, 6 and an upper, T-shaped groove 7 on the opposite side of the chamfers 5, 6. Between the chamfers 5, 6, there is a second T-shaped groove 9 which is provided for connecting them with a non-depicted grinding machine. The T-shaped groove 7 in turn serves to receive a backing material 10. The backing material 10 is first of all provided with a padding 3 on the upper side which projects from the sanding pad mounting 2, a sliding layer 4 being furthermore applied onto the padding. The sliding layer 4 can consist, for example, of a graphite layer or a graphite woven. The backing material 10 can consist, for example, of wood, plastic, or metal. The lower surface of the backing material 10 includes two tongues 27, 28 which engage with the groove 7 of the sanding pad mounting 2. By the T-groove 7 and the two tongues 7, 8, a firm connection between the backing material 10 and the sanding pad mounting 2 is achieved, whereby the occurring forces by the grinding process are absorbed by the groove 7.

In accordance with the present invention, the padding 3 consists of a spacer fabric with two loosely woven textile surfaces 11, 12 which are connected to each other by pile threads, so that the spacer fabric is permeable for a cooling medium.

The sanding pad mounting 2 furthermore includes a plurality of chambers 13, 14, 15, 16, 17 which are predetermined by the extruded profile, wherein the chamber 14 can be used for supplying a cooling medium, and the chamber 16 can be used for discharging the cooling medium. The cooling medium flows, according to the arrow structure 18, from the chamber 14 through at least one bore 19, 20 of the sanding pad mounting 2, and at least one passage 23, 24 of the backing material 10 into the padding 3, and from the latter via at least one passage 25, 26 of the backing material 10 and at least one bore 21, 22 into the chamber 16, so that a continuous flow of the cooling medium through the padding 3 is given, and a cooling of the padding 3 and the sliding layer 4 is possible during the grinding process.

Figure 2:
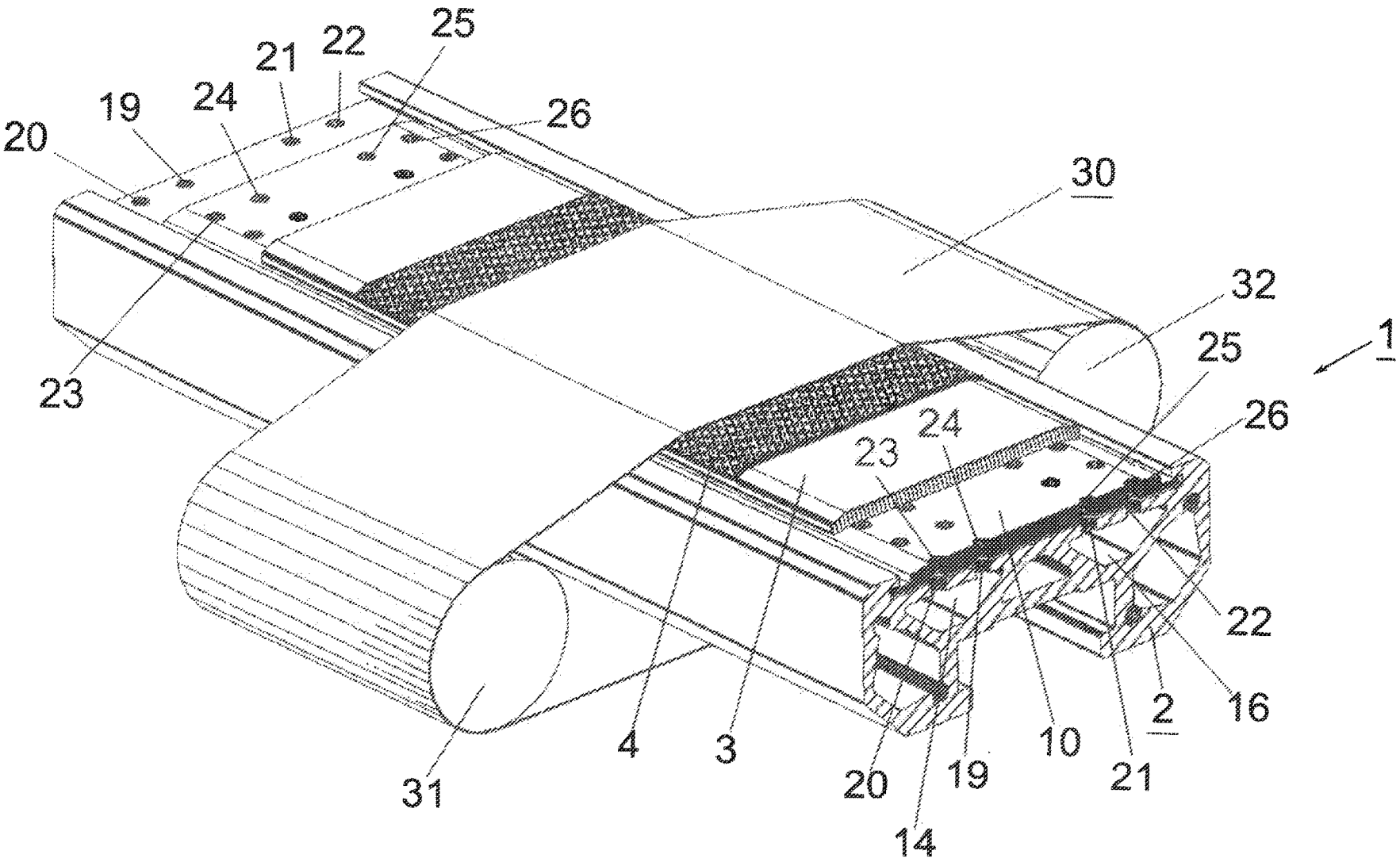
FIG. 2 shows, in a perspective view, the press-on element with an abrasive belt.

FIG. 2 shows the press-on element 1 in connection with an abrasive belt 30 in a perspective view. It is a schematic view to better represent the arrangement of the individual components, wherein in particular the abrasive belt 30 has a substantially larger width and is shown with a reduced width for a better understanding to illustrate the position of the press-on element 1 with the further components. The abrasive belt 30 is designed as a continuous belt and is guided over and driven by deflection rollers 31, 32. On the side facing to the outside, the abrasive belt 30 is coated with an abrasive material, such as corundum, to work the not represented workpieces. The perspective view in this case shows an arrangement in which the abrasive belt 30 is pressed against the workpiece from below, wherein in a wide belt grinding machine, two of such abrasive belts can be employed which can work the workpiece simultaneously from above and from below.

The press-on element 1 with the sanding pad mounting 2, the padding 3 and the sliding layer 4 extends transversely to the abrasive belt 30. Both the padding 3 and the sliding layer 4 are only partially represented for illustration purposes. Normally, the padding 3 and the sliding layer 4 extend across the complete length of the press-on element 1 to press the abrasive belt against the workpiece over a large surface. The structure of the press-on element 1 corresponds to that of FIG. 1, wherein from the perspective view, the bores 19, 20, 21, 22 of the sanding pad mounting 2 which are arranged distributed across the complete length of the grinding press-on element 1 and are clearly visible. Furthermore, the passages 23, 24, 25, 26 of the backing material 10 corresponding to the bores 19, 20, 21, 22 can be seen. Via the chamber 14 of the sanding pad mounting 2, the cooling medium can be supplied, and discharged via the chamber 16, wherein the cooling medium gets from the chamber 14 via the bores 19, 20 and passages 23, 24 into the padding 3, and via the further passages 25, 26 and bores 21, 22 into the chamber 16 of the sanding pad mounting 2, so that the cooling medium, for example air, can flow through the padding 3 under pressure. The flow velocity can be accelerated by corresponding measures, such as for example pressure-increasing devices.

The padding 3 itself has no passages and is sealed to the outside by the sliding layer to such an extent that a flow can only occur within the padding 3.

LIST OF REFERENCE NUMERALS

1 press-on element
2 sanding pad mounting
3 padding
4 sliding layer
5 chamfer
6 chamfer
7 groove
8 narrow side
9 groove
10 backing material
11 textile surface
12 textile surface
13 chamber
14 chamber
15 chamber
16 chamber
17 chamber
18 arrow structure
19 bore
20 bore
21 bore
22 bore
23 passage
24 passage
25 passage
26 passage
30 abrasive belt
31 deflection roller
32 deflection roller

The invention claimed is:

1. A press-on element (1) for a wide belt grinding machine comprising:
a backing material (10) with a padding (3), and
a sliding layer (4),
wherein the padding (3) comprises a spacer fabric, and
wherein a cooling medium penetrates, via a first chamber of a sanding pad mounting, through at least one first passage, into the spacer fabric and, after the cooling medium has flowed through the spacer fabric, exits through at least one second passage into a further chamber of the sanding pad mounting.

2. The press-on element (1) according to claim 1, wherein the padding (3) consists of the spacer fabric.

3. The press-on element (1) according to claim 1, wherein the spacer fabric comprises at least two woven textile surfaces (11, 12), and/or the two woven textile surfaces (11, 12) are connected to each other by pile threads.

4. The press-on element (1) according to claim 1, wherein the spacer fabric has a thickness tolerance of +/−5 hundredth of a millimeter.

5. The press-on element (1) according to claim 1, wherein the spacer fabric comprises moisture-stable synthetic fibers.

6. The press-on element (1) according to claim 1, wherein a compressive strength of the padding (3) is determined by a number of pile threads, a structure, a length and/or a thickness.

7. The press-on element (1) according to claim 6, wherein the spacer fabric is penetrated by the cooling medium, and/or a gas is employed as the cooling medium.

8. The press-on element (1) according to claim 1, wherein the cooling medium flows through the spacer fabric in a longitudinal and/or a transverse direction.

9. A method for grinding wood or wood substitute materials, comprising:
providing the press-on element (1) according to claim 1; and
cooling the press-on element (1) during a grinding process by the cooling medium which flows through the padding (3).

10. The method according to claim 9, wherein the cooling medium is supplied and discharged via the sanding pad mounting (2).

11. The method according to claim 9, wherein a circulation or flow of the cooling medium is effected via the sanding pad mounting (2) through the padding.

12. The method according to claim 9, wherein the cooling medium is supplied and discharged under pressure.

13. The method according to claim 9, comprising:
providing a constant flow of the cooling medium through the first chamber (14) of the sanding pad mounting (2) into the spacer fabric, and
discharging the cooling medium through the further chamber (16) of the sanding pad mounting (2).

14. The press-on element (1) according to claim 1, wherein the padding (3) comprises the spacer fabric in a longitudinal and/or a transverse direction which is hemmed by edge strips of another padding material in the longitudinal and/or the transverse direction.

15. A press-on element for a wide belt grinding machine, comprising:
a backing material with a padding that at least partially comprises a spacer fabric;
a sliding layer; and
a sanding pad mounting having:
at least one first chamber from which a cooling medium is supplied through at least one passage in the backing material into the spacer fabric, and
at least one second chamber through which the cooling medium is discharged from the spacer fabric through a further at least one passage in the backing material.

* * * * *